US005460065A

United States Patent [19]

Balmer

[11] Patent Number: 5,460,065

[45] Date of Patent: Oct. 24, 1995

[54] LOCKING TOOL

[76] Inventor: Bart Balmer, Box 489, Shady, N.Y. 12409

[21] Appl. No.: 91,314

[22] Filed: Jul. 14, 1993

[51] Int. Cl.[6] ..... B25B 7/12

[52] U.S. Cl. ..... 81/368; 81/370

[58] Field of Search ..... 81/368–370

*Primary Examiner*—James G. Smith

*Attorney, Agent, or Firm*—Schweitzer Cornman & Gross

[57] ABSTRACT

An improved locking tool having a toggle mechanism extending between the operating handles has a cam located at an intersection of two of the elements of the toggle to vary the distance between the points of contact between the mechanism and the handles as the tool is opened or closed. The adjustment to such distance provides for increased ease of operation with less operating force. Disclosed embodiments include a further mechanism to assist in the separation of the handles and to resealably lock the handles in the clamped position.

20 Claims, 9 Drawing Sheets

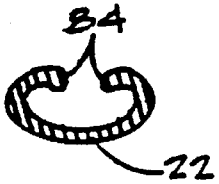
FIG. 11
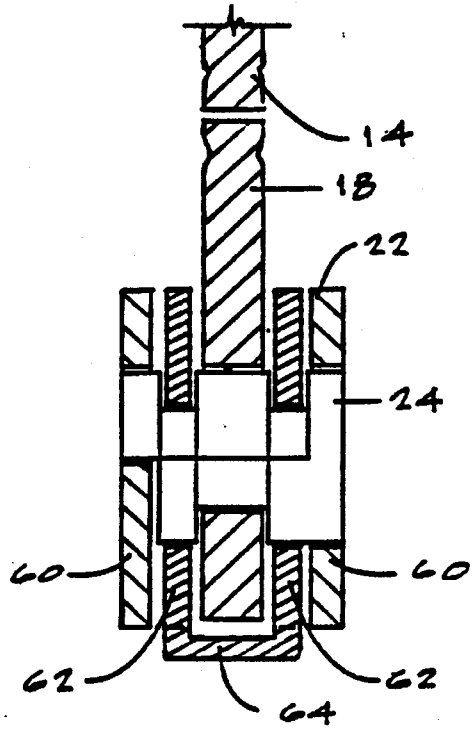
FIG. 8
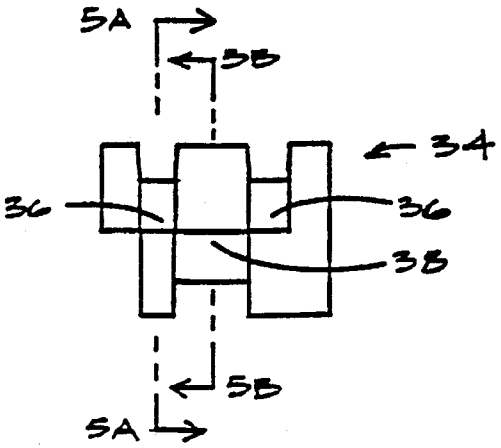
FIG. 4
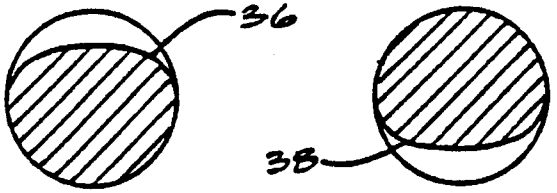
FIG. 5A
FIG. 5B

LOCKING TOOL

BACKGROUND OF THE INVENTION

Hand tools of the pliers type having locking mechanisms to maintain the opposed jaws in a gripping position are well known. Typically such tools incorporate a fixed handle and jaw element and a movable jaw pivoted to the handle, operable by an attached movable handle.

After the jaw separation is coarsely adjusted, compression of the handles drives a toggle mechanism beyond a dead center point to a position where the jaws are locked onto the workpiece. This permits the tool to be maintained in a clamped position without the continued maintenance of manual pressure.

The toggle action is conventionally developed around three pivot points in the operating mechanism. The dead center point exists when the three pivot points are in a line. The line is called the "power line", and extends from a first pivot point joining the movable handle to the movable jaw, through a second, intermediate pivot in the toggle link mechanism between the handles, to a third pivot point at the other end of the toggle mechanism which is in contact with the fixed handle. Upon compressing the handles to close the jaws, the center pivot point is forced across the power line, maintaining the jaws in the closed position until the center pivot is forced back across the power line. Typically, this is performed with the assistance of a release lever.

The locking and unlocking functions may require a fair amount of manual effort to cause the toggle linkage pivot point to cross the power line, which increases as the compressive force locking the jaws increases. In particular, release of the tool from the workpiece is often accompanied by an almost explosive separation of the tool handles as the power line is crossed. Accordingly, a variety of mechanisms have been developed to lessen the necessary force, typically in conjunction with release of the tool, rather than during engagement of the tool about a workpiece. These mechanisms are often complicated, requiring additional levers and other elements between the handles. They often do not provide a satisfactory solution to the problems inherent in such locking tools.

It is accordingly an object of the present invention to provide an engagement and release mechanism for toggle lock tools which can operate with minimal applied force.

An additional object of the present invention is to provide an engagement and release mechanism in which the transfer across the power line is accomplished in a smooth and efficient manner, to avoid pinching, snapping and jerking of the tool.

Another object of the present invention is to provide an engagement mechanism which allows for increased gripping force to be applied by a given size tool.

Still another object of the present invention is to provide an engagement and release mechanism which is free of secondary mechanisms which can crowd the space between the handles, and which may be prone to interference with tool operation and which can be unintentionally operated, causing premature tool release.

An additional object is to reduce loss of gripping force as the center pivot passes the centerline into its locked position.

Yet a further object of the present invention is to provide an engagement and release mechanism which may be incorporated into tools with minimal cost.

A still further object of the present invention is to provide an engagement and release mechanism in combination with a grip handle, which may be of improved comfort to the user.

BRIEF DESCRIPTION OF THE INVENTION

The above and other objects and purposes of the present invention are fulfilled by a toggle mechanism in which a camming action is developed as the central toggle pivot point traverses the power line. A pair of opposed cam surfaces in the toggle assembly are utilized to allow for cam action to be developed both upon jaw setting and release. As the movable handle opens or closes, the effective position of the movable jaw shifts about the camming surfaces, resulting in the simultaneous increase or decrease of pressure in the power line while the toggle line pivot passes across the power line into the locked or unlocked position, depending on the direction of handle travel. By providing a smooth camming surface during release to relieve compressive force before the toggle link pivot traverses the power line, the rough "kick" which occurs in conventional release mechanisms is greatly reduced or avoided entirely. In addition, because the cam action distributes locking pressure over a broader section of arc relative to the toggle link pivot, traverse occurs smoothly.

In one embodiment of the invention, means may be provided to retain the locking handle in the locked position to further guard against inadvertent disengagement of the jaws. This additional feature is of benefit in situations where the tool may be subjected to vibration during use. Such lock means may comprise a resilient clamp member releasably retaining the locking handle and toggle mechanism together. Means may also be provided for reduction of play in the adjustment screw mechanism for jaw opening control.

In another embodiment of the invention, means may be provided to prevent inadvertent resetting or slippage of the jaw adjustment screw. In yet another embodiment, typically incorporating one or more of the previous features, the movable handle is contoured to provide an improved comfort grip for the hand.

BRIEF DESCRIPTION OF THE DRAWINGS

A further understanding of the present invention may be achieved by consideration of the following detailed description of preferred, but nonetheless illustrative embodiments of the invention when reviewed in conjunction with the annexed drawings, wherein:

FIG. 4 is a front elevation view of the cam element providing the pivot point between the movable jaw and compound link;

FIGS. 5*a* and 5*b* are side views in section taken along lines 5*a* and 5*b*, respectively, in FIG. 4;

FIG. 8 is a partial front elevation view of the movable handle portion of the embodiment of FIG. 7 taken along line 8—8 in FIG. 7;

FIG. 11 is a cross-sectional view along line 11—11 in FIG. 7 illustrating the configuration of the grip section of the movable handle of the tool.

DETAILED DESCRIPTION OF THE INVENTION

Figure 1:
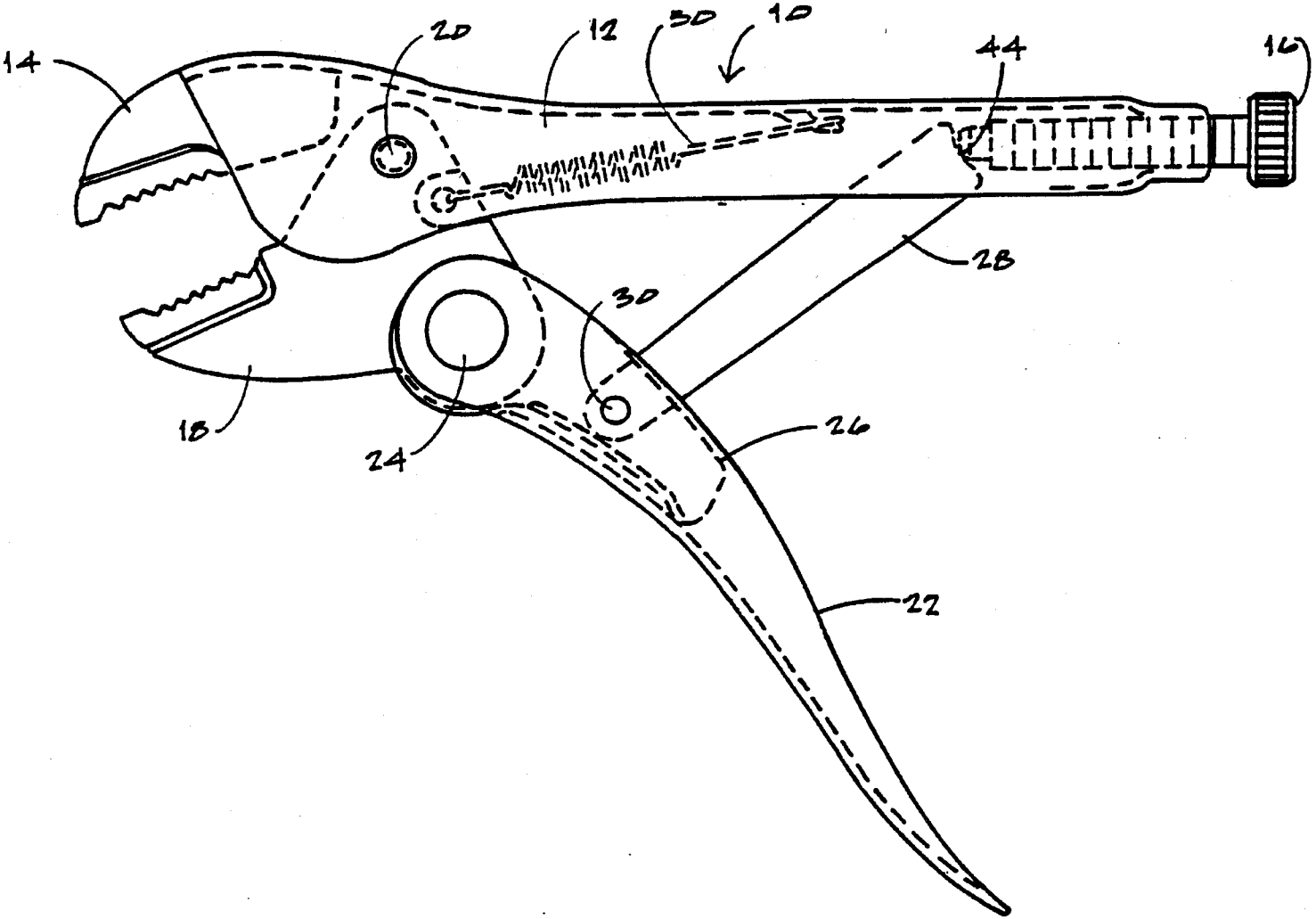
FIG. 1 is a side view of a tool embodying the present invention presenting the jaws in the open position prior to engagement with a workpiece.

As presented in the Figures, the tool 10 includes a fixed arm or handle 12 bearing a stationary jaw 14 at a first end and a threaded adjustment screw 16 at the opposite end. The adjustment screw is typically threaded through a portion of the handle formed as a mating threaded bore. A second movable jaw 18 is pivotally mounted to the fixed handle 12 at pivot point 20 and is further pivotally connected to movable handle 22 at pivot point 24. Pivot point 24 also supports one end of link element 26, which is thus also pivotally connected to the movable handle 22. A toggle element 28 extends between link 26 and fixed handle 12, and is pivotally attached to the link by pivot pin or pintle 30. The opposed end of the toggle rests against the internal end of adjustment screw 16 at 44 in a manner which allows the toggle to pivot about the point of contact therebetween. Turning the adjustment screw 16 changes the distance between the point of contact 44 between toggle 28 and the adjustment screw and the pivot point 20 for the movable jaw, resulting in the varying of the opening distance between the jaws. This allows different size workpieces to be accommodated between the jaws, and varying pressures to be applied. The combination of the link 26 and toggle 28 form the locking mechanism, allowing the tool jaws to be locked about a workpiece.

Figure 2:
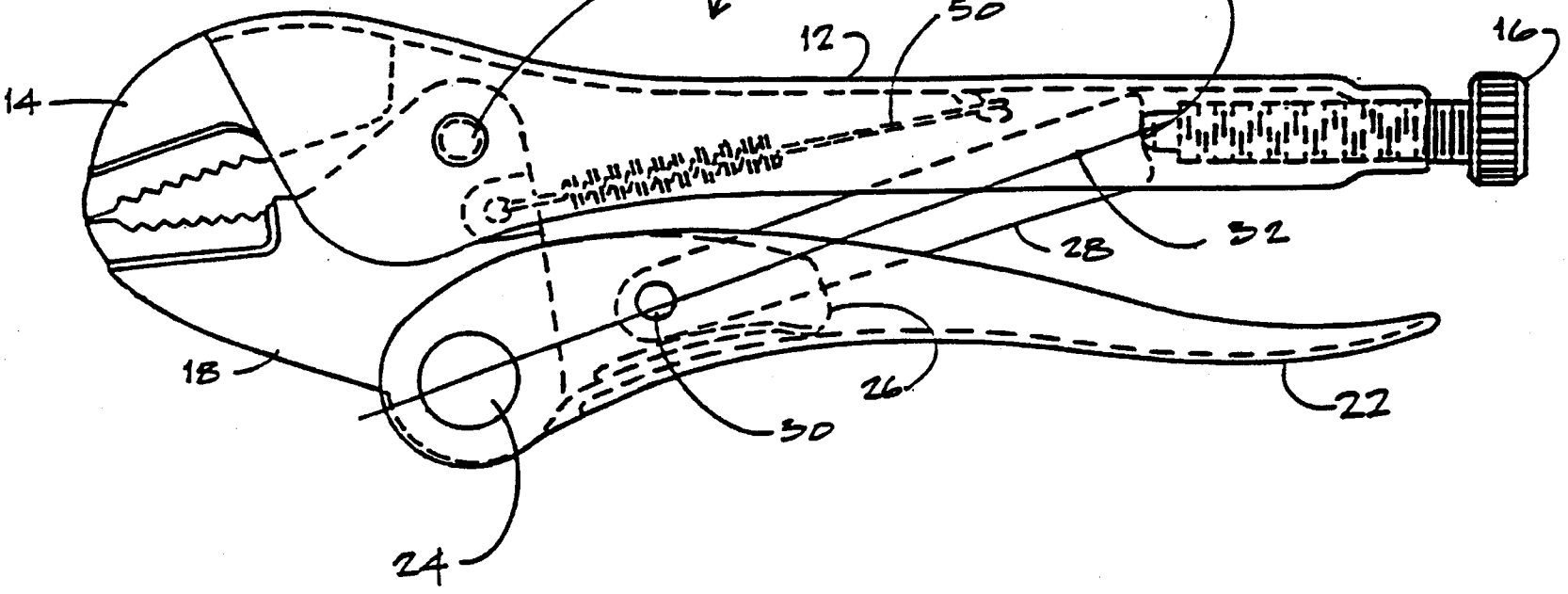
FIG. 2 is a side view of the tool with the jaws in the closed position as clamped about a workpiece.

As seen in FIG. 2, the power line 32 is defined by a straight line which extends from the point of interconnection between the movable jaw 18 and movable handle 22 as defined by pivot point 24, on one end, to the point of contact 44 between the toggle 28 and the fixed handle and adjustment screw 16. Between these two end points is the pivot pin or pintle 30. The passing of the pivot pin 30 across the power line in the upward direction, as depicted in the Figures, engages the locking of the tool, while the passage downward results in unlocking. At higher grip pressures with a conventional tool, a large amount of force is required to be applied by the user to the tool handles to cause the pivot point 30 to cross the line and transfer between the unlocked and locked positions. When unlocking, the sudden release of the stored energy can cause the grip lever and fixed handle to violently fly apart.

In conventional locking pliers as the handle is closed and pivot point 30 approaches the power line orientation the straight-line distance between the first and third pivot points 24 and 44 increases, pivoting the movable jaw about pivot point 20 towards the fixed jaw to clamp the workpiece. As the power line and dead center position are traversed, the direction of jaw travel tends to reverse, as the distance between the first and third pivot points 24 and 44 is greatest in power line alignment. Passing the power line decreases this distance, resulting in slight reduction of closure pressure on the jaws.

Crossing the power line can require a significant amount of force, both for jaw setting and release, particularly at higher grip pressures. As the pivot 30 crosses the power line of a conventional tool, there can be an abrupt finger-jarring "snap" as the toggle locks or breaks. The present invention alleviates this problem by providing a more continuous application of force as the jaws are set and/or released. By utilizing a contoured camming surface as part of the locking mechanism, the force is applied in a more controlled manner, and required handle separation force is greatly reduced.

A further benefit of the use of such a cam surface is that the slight release of jaw pressure which occurs in conventional locking tools after the power line is traversed is substantially eliminated.

Figure 3:
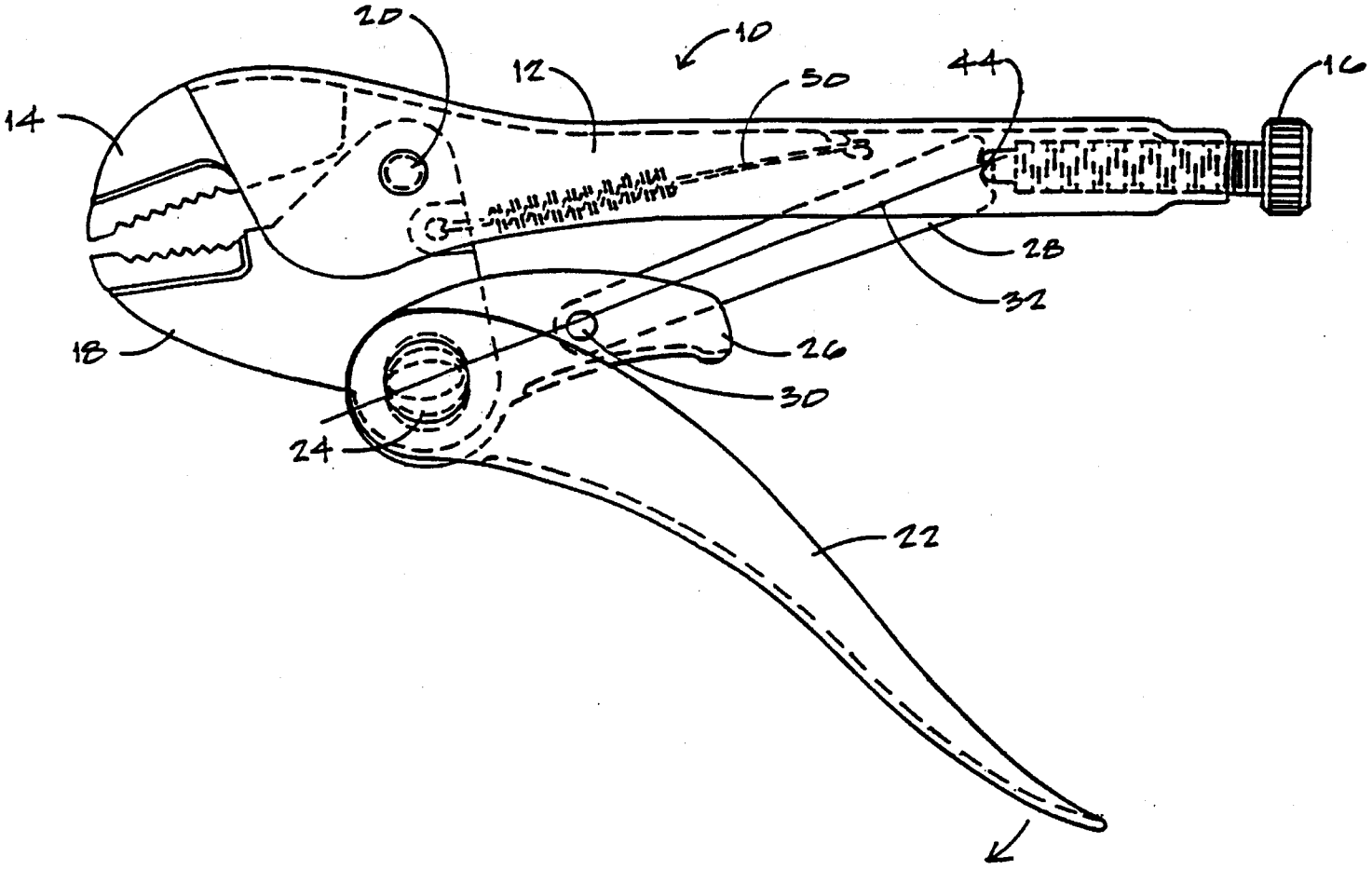
FIG. 3 is a side view of the tool with the jaws in the closed position, the movable handle being rotated to release the jaws.
Figure 6A:
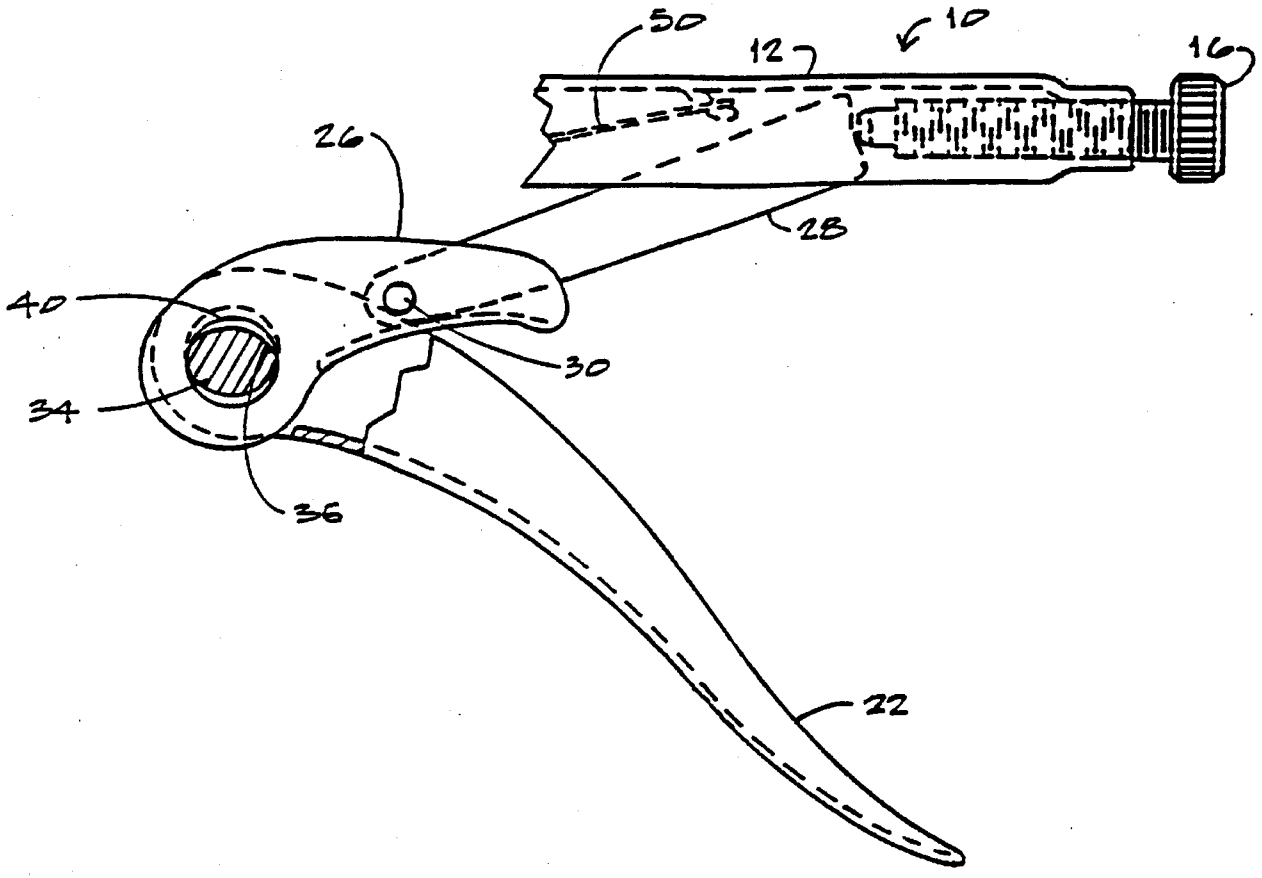
FIGS. 6*a* and 6*b* are views of the handle-link arm and handle-jaw connections, respectively, detailing the orientation of the camming action therebetween.
Figure 6B:
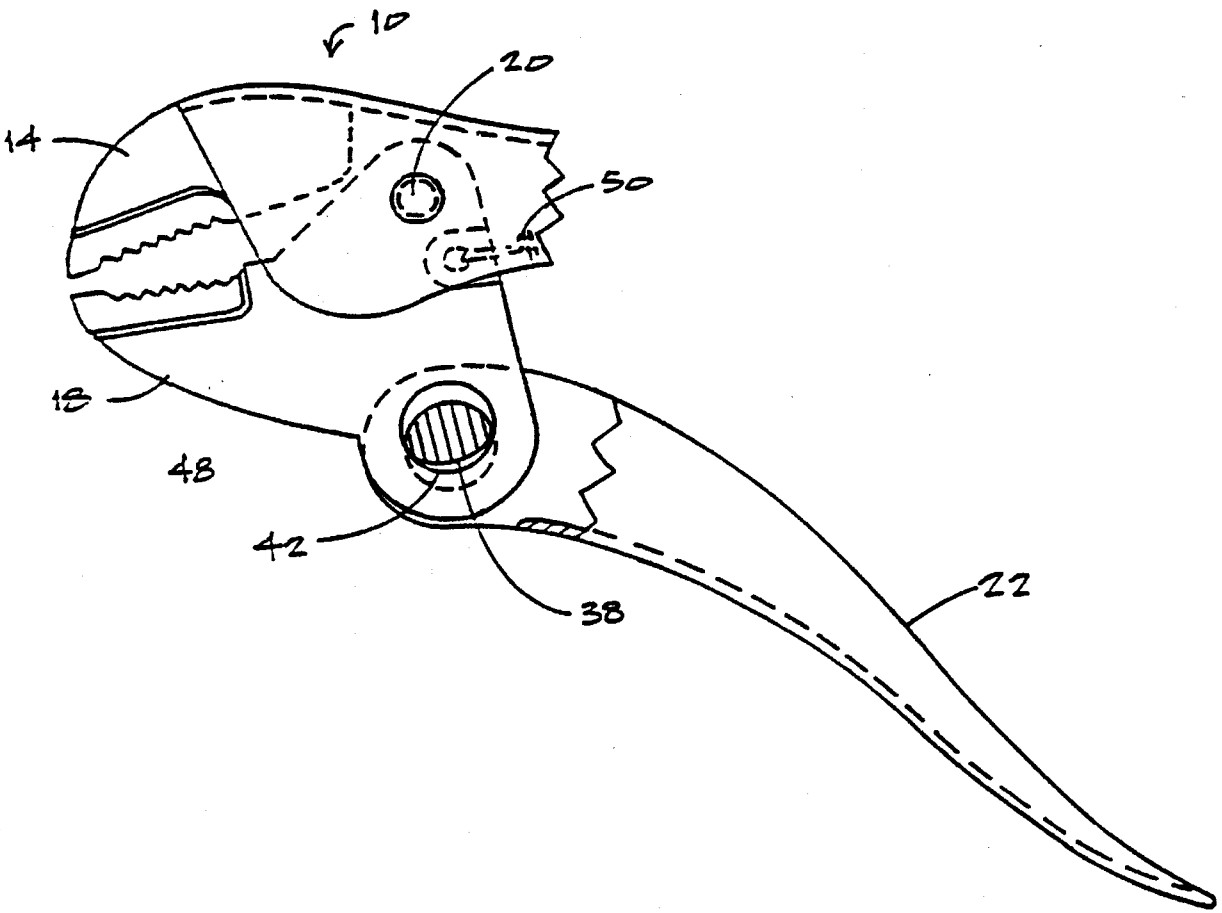

In order to provide such a smooth, low-effort transition across the power line, a cam assembly 34, as seen in FIGS. 4, **5*a* and 5*b*, defines the first pivot point 24. As seen in FIG. 3, the cam assembly is mounted to movable handle 22, and provides a pair of camming actions between the handle and the movable jaw 18 and the compound link 26 as the jaw is opened and closed. The cam element 34, which is rigidly affixed to, or made a part of, the movable handle 22, includes a pair of first cam surfaces 36 and a second cam surface 38. As shown in FIGS. 6*a* and 6*b*, the first cam surfaces 36 are spaced to coact with and engage a pair of circular bores 40 in link 26, which is typically U-shaped in cross-section, while the cam surface 38 engages a bore 42 in the movable jaw 18. The cam element 34 is rigidly affixed to the movable handle 22, such that the opposed main portions of the camming surfaces lie along the power line 32 when the pivot points 24, 44 and 30** are in alignment.

During the locking cycle, the bottom surface of compound link 26 is engaged by the movable handle 22 due to the opposing force exerted by the toggle 28 and is rotated counterclockwise with the handle as a unit, as shown in the Figures. With no relative motion between these elements, the first cam element is non-functional.

As may be seen in FIG. **6*b*, as the handle closes, the point of contact and thus the pivot point between the handle 22 and the movable jaw 18 is at the left edge 48 of the cam surface 38, contact being facilitated by spring 50 providing a counterclockwise bias to the jaw about pivot point 20**. As the handle and jaw close, the contact point moves clockwise on the cam surfaces, increasing the extension of the link and toggle between the end pivot points. As the power line is crossed, continued cam rotation further extends the distance between the end points, until the link/toggle pivot stops in its locked position. Marginal loss of jaw grip pressure is thereby eliminated since camming action continues to occur after the power line has been traversed, thus providing the benefit of increasing jaw closure force until full closure is obtained. Friction among the cam, link and jaw prevent the handles from separating through all grip pressure ranges.

Since the compressive forces generated by the cam can be substantial, resulting in accelerated wear of the members at the points of contact with the cam surfaces, bushings of an appropriate material may be utilized to mitigate wear and prolong the useful life of the tool.

When jaw release is desired, downward pressure on the movable handle separates the handle from the link, as shown in FIGS. 3 and **6*b*, overcoming the frictional force between the cam element and the mating compound link bore, with cam thus rotating clockwise with respect to the compound link. As it does, the point of contact moves counterclockwise on the cam surfaces, shortening the distance between the end points of the power line and thus decreasing jaw force. Thus, while the distance between the pivot points is increasing as the power line is approached, there is a simultaneous decrease in the distance due to cam operation. As jaw pressure is released, the frictional effect between the handle and link lessen, allowing the link to rotate clockwise. This drops the pivot pin 30** across the power line, resulting in jaw separation.

Figure 12:
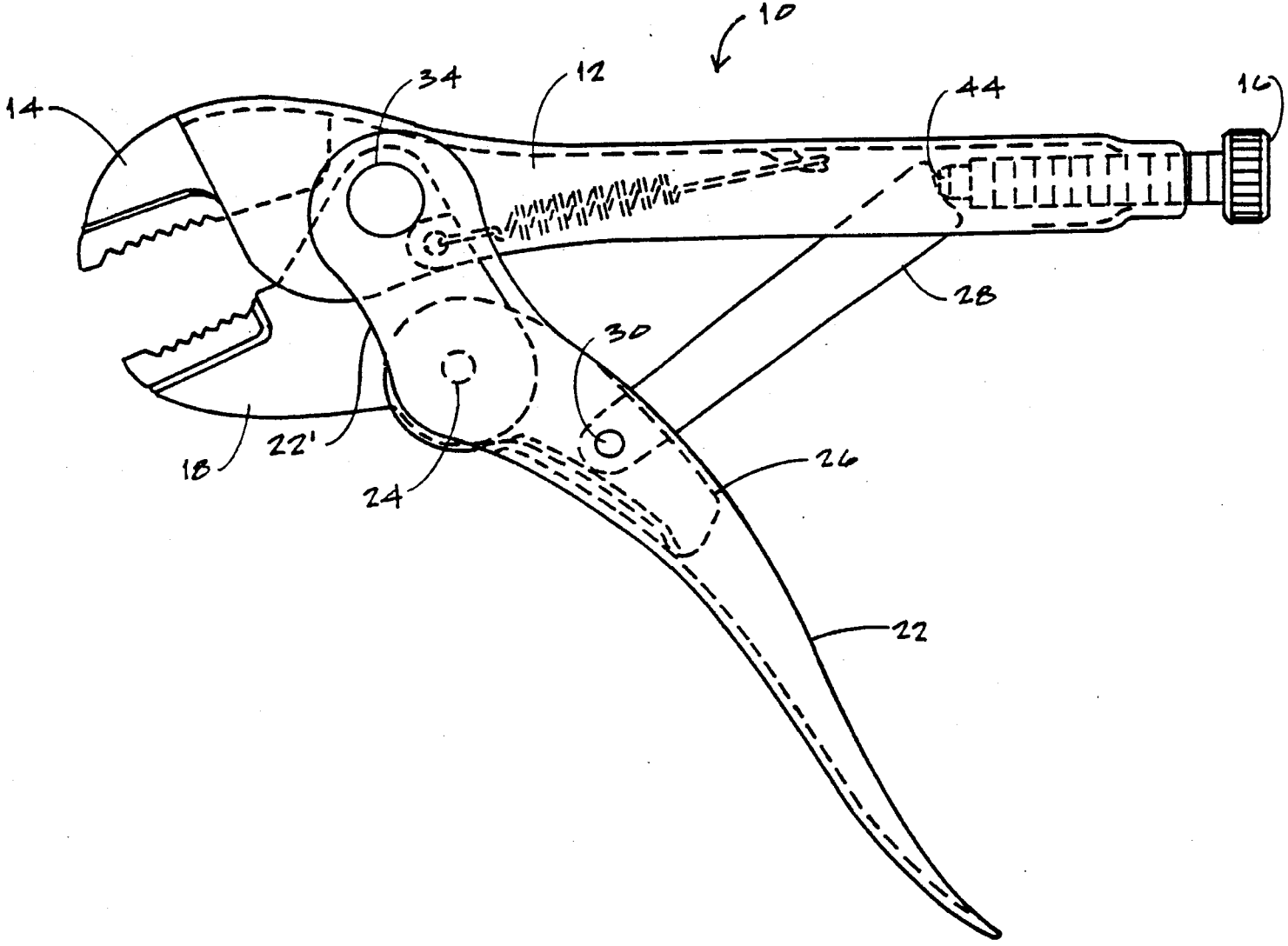
FIG. 12 is a side view of a tool embodying an alternative embodiment of the invention.

Although the preferred location for the cam is at the pivot point 24 defining the juncture between the link 26, movable handle 22 and movable jaw 18, it also can be located at the pivot point 20 between the movable jaw and the stationary handle 12, or at the pivot point 30 between the link and toggle 28. When located between the movable jaw and the stationary handle, as depicted in FIG. 12, the movable handle 22 is extended to be affixed to the cam assembly 34, and thus the pivot point 20 now defines a compound pivot point between the fixed handle, movable jaw, and movable handle. The pivot point 24 is solely between the movable jaw and link. The movable handle would be provided with a front fork defining the extension portion 22', which would overlie the movable jaw-link connection.

Because the movable handle is connected to the link and toggle only through the cam mechanism, upon opening for pressure release the grip lever can traverse a fair amount of arc before the frictional contact with the link is sufficiently reduced to allow rotation of the link to bring the pivot pin across the power line. This results in significant handle travel not needed for efficient functioning of the tool. The mechanism set forth in FIG. 7 may be incorporated into the present invention to minimize such travel, increasing the speed and ease of use of the tool.

In particular, and as seen in the Figure, the forward end of toggle 28 is formed into a grooved bearing portion 58 serving as a guideway for the cable portion 56 of a resilient link 52, extending between the forward end of the movable handle 22 and the rear end of toggle 28, adjacent the forward end of adjustment screw 16.

As shown in the Figure, the resilient link includes series spring 54, which is in the tensioned state when the jaws are closed and the movable handle adjacent the stationary handle. As the movable handle pivots clockwise to release jaw pressure, the restoring spring force applied to the cable 56 provides a downward force to the forward end of the toggle, the direction shown by the arrow, providing additional force against the toggle and developing an additional clockwise movement about the cam and assisting in driving the pivot pin 30 across the power line. This additional force, while insufficient to move the link, toggle and movable handle out of the locked position, ensures that motion of the link and toggle closely follows the travel of the movable handle during jaw release. This results in prompt jaw release during the unlocking motion, providing swift tool response and elimination of unnecessary handle motion.

In the closed and locked position, the downward force exerted by the resilient means 52 against the toggle is somewhat balanced by the closing force exerted upon the movable handle by the same resilient means 52, tending to hold the handle in the closed position. When the handle is rotated open by the operator, however, the additional tension placed upon the spring portion 54 becomes sufficient to rotate the toggle, allowing the pivot pin to begin prompt traverse of the power line.

Normally, the friction between the cam and associated elements is sufficient to maintain the handle in a locked position, notwithstanding the substantially smoother transition across the power line which occurs as a result of the present invention. Especially when tool use is intended for high vibration applications, further assurances that the handle remains in the locked position until release is desired may be provided.

Figure 9:
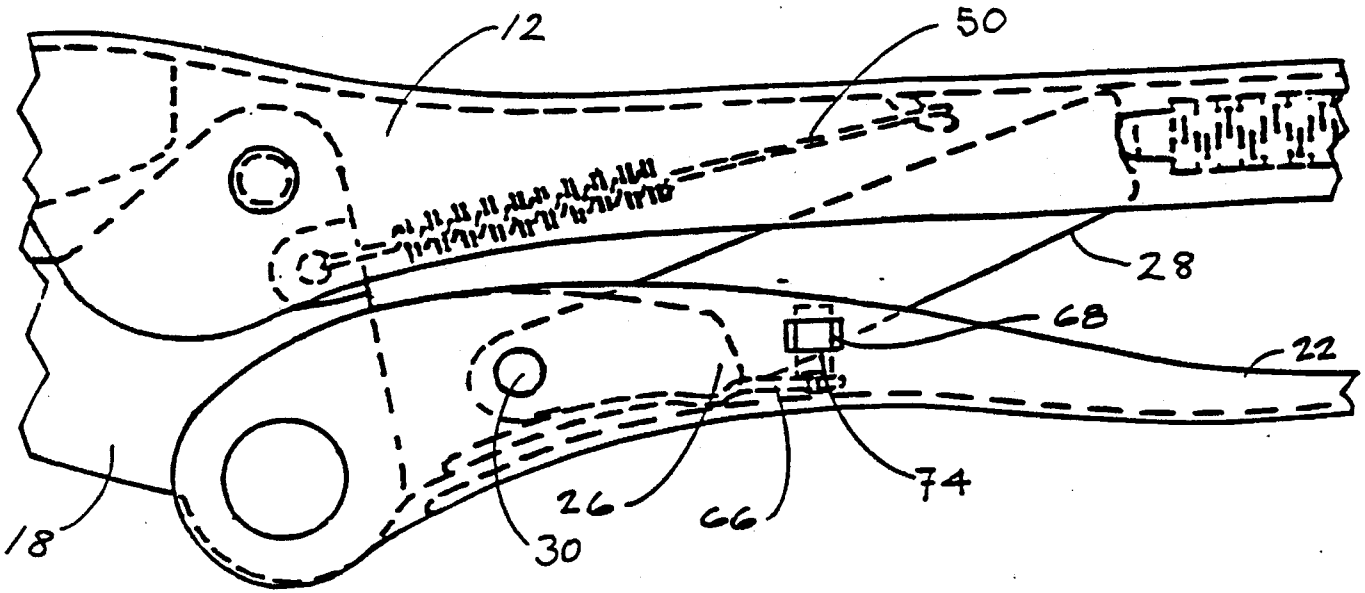
FIG. 9 is a side view of the tool of the present invention depicting handle-retaining means and means for limiting adjustment screw play.
Figure 10:
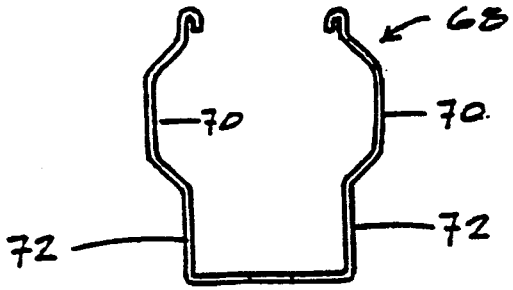
FIG. 10 is a front elevation view of the handle clamp mechanism shown in FIG. 7.

As depicted in FIG. 9, link element 26 may be elongated at its rearward end to provide a mounting surface 66 for clamp means 68 designed and dimensioned to exert a retaining force between the link and the movable handle 22 when the movable handle is in the closed position. The clamp may be riveted or otherwise fastened as known in the art to the link. As best seen in FIG. 10, the clamp may be in the general shape of a U, formed of a resilient metal, with a pair of outwardly-lying projections or bulges 70 on the opposed arms 72 thereof. The opposite sides of the movable handle 22 are each provided with a rectangular aperture 74, dimensioned to accept a projection 70, and positioned such that when the handle embraces the link and toggle in the fully closed position the engagement occurs. The retention of the handle and link together decreases the likelihood that vibration and the like can result in unwanted travel of the handle, resulting in a releasing force being applied to the cam, causing premature jaw release.

Figure 7:
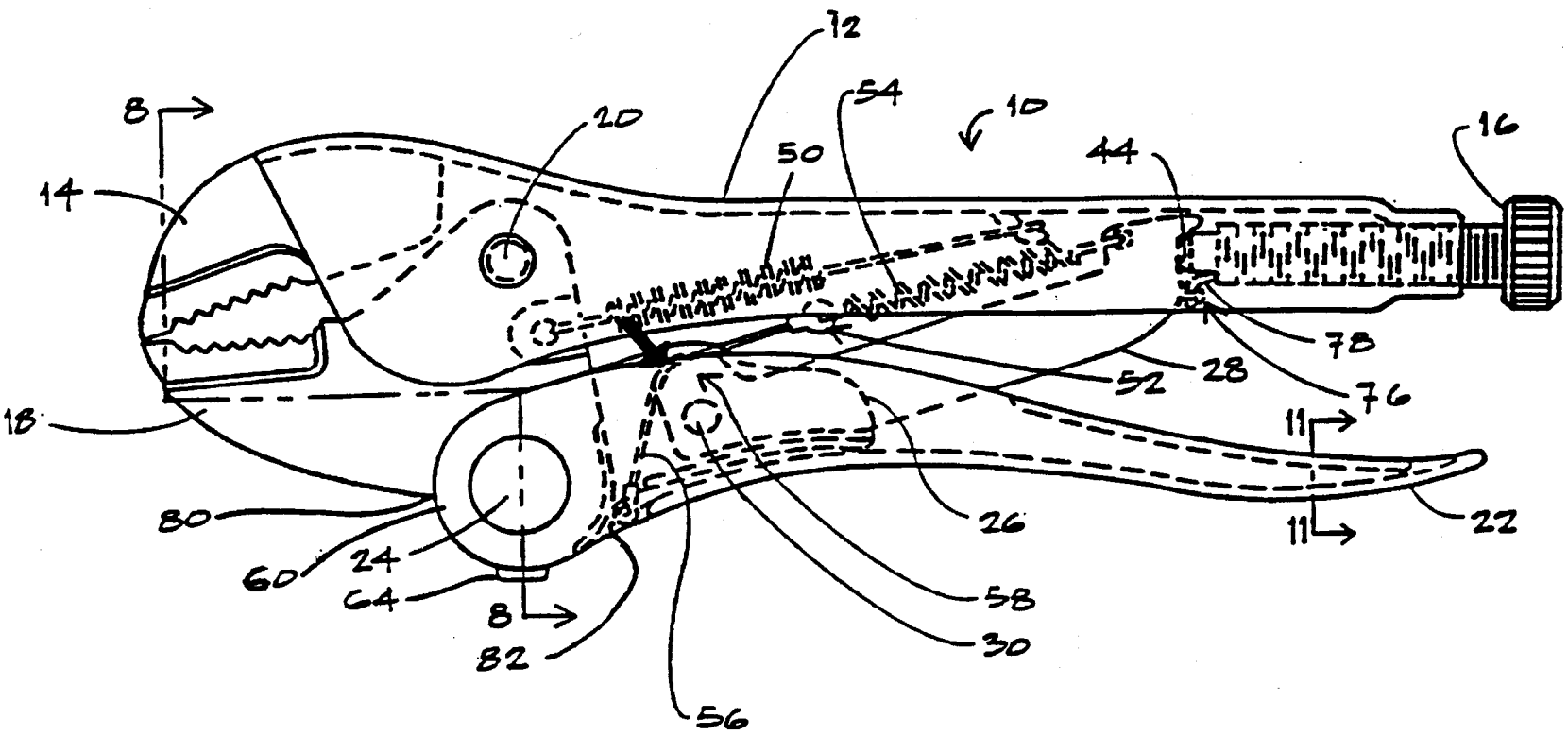
FIG. 7 is a side view of a tool of the present invention presenting alternative and joint means for instituting jaw unlock with a minimum of grip handle travel and having a handle clamp.

As an additional feature to prevent excessive handle travel without link motion, FIGS. 7 and 8 depict the movable handle 22 being formed with a pair of arms 60 which overlie the arms 62 of the link 26, which in turn surround the lower end of the movable jaw element 18. The forward end of the link arms may be provided with a link crossbar 64 between the arms, which engages the lower surface of the movable jaw at 80 at the end of clockwise rotation as shown in the Figures. Because the arms of the movable handle merge into a solid element behind the front end of the link at 82 as the handle rotates, the link bar engages the handle, and ensures that the link rotates with additional handle travel, causing pivot pin kick-over across the power line. As an additional feature of the construction, once the pivot pin crosses the power line and the jaw spring 50 urges the jaws apart, the crossbar engages the lower portion of movable jaw at 80, preventing further and unnecessary jaw opening for the efficient function of the tool. The inclusion of the crossbar may be incorporated in embodiments either with or without the resilient means 52.

Yet a further structural improvement which may be incorporated into the present invention is also depicted in FIG. 7. In conventional locking tools there is a tendency upon jaw release for the toggle 28 to jar against the adjustment screw 16 during the shock of transition across the power line. This can result in changes in the position of the screw. The present invention provides for minimization of such shocks by use of a mechanism which provides for a frictional restraint between the link and adjustment screw. This maintaining force, substantially lessens the likelihood of the adjustment screw changing its position.

As shown in FIG. 7, a means for maintaining the relationship between the toggle and adjustment screw is the provision of a resilient clamp means 76, shown in the form of a wedge or stop 78 mounted to the rear end of the toggle 28 and adapted and dimensioned to frictionally engage the forward end of the adjustment screw. The stop or wedge, which may be of spring steel rubber or other elastomeric material, provides sufficient coupling between the two elements to minimize the shocks transmitted by the link passing over the power line while at the same time providing a brake to rotational forces generated as a result thereof. The frictional contact is insufficient, however, to provide any meaningful barrier to manual adjustment of the screw as required.

As a further feature of the present invention, the inside surfaces of the movable handle 22 may be formed with contoured or rolled edges 84 in the area gripped by the user during jaw unlocking. This is shown in FIG. 11. Such a structure eliminates sharp edges, improving user comfort.

I claim:

1. A locking tool of the type having a fixed handle and jaw and a movable handle and jaw, said handles connected to a pivoting link and toggle pivotally joined together at a first pivot point and affixed to said fixed handle at a second pivot point and to said movable handle at a third pivot point, said second and third pivot points defining a power line therebetween, a traverse thereof by said first pivot point in a first direction locking said handles and jaws and a traverse in a second direction unlocking said handles and jaws, the improvement comprising a cam located at one of the pivot points to vary the distance between said second and third pivot points during handle closure and handle separation.

2. The improvement of claim 1 wherein said cam is adapted to increase the distance between said second and third pivot points after the traverse of said powerline in said first direction.

3. The improvement of claim 1 wherein said cam is located at said third pivot point.

4. The improvement of claim 3 wherein said cam has a first cam surface bearing against said link and a second cam surface bearing against said movable jaw.

5. A locking tool comprising a fixed handle having a fixed jaw member at one end and jaw pressure adjusting means at the other end; a movable jaw pivotally mounted to said fixed handle at a first pivot point, said jaws being adapted to hold a workpiece therebetween; a movable handle pivotly connected to said movable jaw at a second pivot point; a toggle mechanism extending between said handles comprising a link pivotly joined to a toggle at a third pivot point, said link being pivotally joined to said movable jaw at said second pivot point and said toggle being pivotally joined to said fixed handle at a fourth pivot point; and a cam located at said second pivot point providing at least one cam surface whereby the distance between said second and fourth pivot points is varied during relative motion of said handles.

6. The tool of claim 5, wherein said cam is dimensioned to lessen the rate of extension between said second and fourth pivot points during jaw closure as a line therebetween is traversed by said third pivot point.

7. The tool of claim 6, wherein said movable handle pivot point is at said first pivot point, said cam being located at said first pivot point.

8. The tool of claim 5, wherein said cam has first and second cam surfaces, said first cam surfaces being in contact with a first element pivotally joined at said one of said pivot points, said second cam surface being in contact with a second element joined at said one of said pivot points.

9. The tool of claim 5, further comprising means for assisting traverse of a line connecting said second and fourth pivot points by said third pivot point during handle separation, comprising resilient means having a first end mounted to said movable handle and a second end mounted to said toggle and an intermediate portion contacting said link said ends whereby an assisting force is applied to said link as said third pivot point traverses said line.

10. The tool of claim 9 wherein said link comprises a curved bearing surface for contact with said resilient means.

11. The tool of claim 10, wherein said resilient means comprise a spring.

12. The tool of claim 5 further comprising a lock to selectively retain said handles in the locked position.

13. The tool of claim 12, wherein said lock comprise a clamp mounted to said link engageable with said toggle when said handles are in the locked position.

14. The tool of claim 13, wherein said handle has at least one aperture, said clamp comprising at least one portion adapted to releasably engage with said at least one aperture.

15. The tool of claim 5, further comprising means to limit the separation of said jaws.

16. The tool of claim 15, wherein said link element has parallel arms supporting said second pivot point, said jaw separation limiting means comprising a crossbar joining said arms, said crossbar dimensioned and located to contact said movable jaw upon handle release.

17. The tool of claim 16 wherein said crossbar is engageable with a portion of said movable handle to link opening motion of said movable handle to motion of said link element about said second pivot point.

18. The tool of claim 5 wherein said adjustment means is an adjustment screw threaded into said fixed handle, said fourth pivot point being located at an end of said screw, said tool further comprising means for maintaining said toggle in pivotal frictional contact with said adjustment screw.

19. The tool of claim 18 in which said maintenance means comprise a resilient element mounted to said toggle applying a frictional force against said adjustment screw.

20. A locking tool of the type having a fixed handle and jaw and a movable handle and jaw, said handles connected to a pivoting link and toggle pivotly joined together at a first pivot point and affixed to said fixed handle at a second pivot point and to said movable jaw at a third pivot point, said second and third pivot points defining a power line therebetween, a traverse thereof by said first pivot point in a first direction locking said handles and jaws and a traverse in a second direction unlocking said handles and jaws, the improvement comprising a cam located at one of said first or third pivot points to vary the distance between said second and third pivot points during handle closure and handle separation, said movable handle being connected to said cam.

* * * * *

UNITED STATES PATENT AND TRADEMARK OFFICE

CERTIFICATE OF CORRECTION

PATENT NO. : 5,460,065

DATED : October 24, 1995

INVENTOR(S) : BART BALMER

It is certified that error appears in the above-identified patent and that said Letters Patent is hereby corrected as shown below:

In the drawings, Fig. 6b, the reference numeral 48 should attach to the left edge of the cam surface 38, as follows:

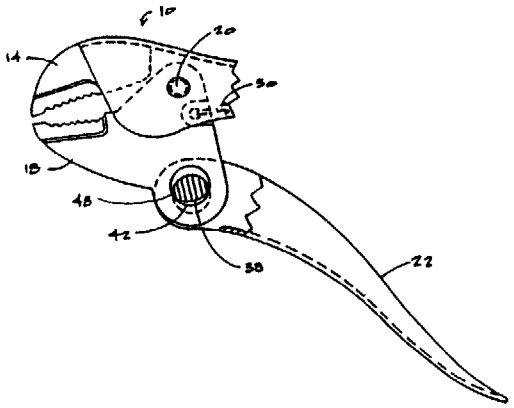

col. 6, line 56, that portion reading "force, substantially" should read --force substantially--.

Signed and Sealed this

First Day of April, 1997

Bruce Lehman

BRUCE LEHMAN

*Commissioner of Patents and Trademarks*

*Attest:*

*Attesting Officer*